US007190381B2

(12) United States Patent
Tsutsui et al.

(10) Patent No.: US 7,190,381 B2
(45) Date of Patent: Mar. 13, 2007

(54) LIQUID CRYSTAL DISPLAY DEVICE AND ADJUSTING METHOD OF THE SAME

(75) Inventors: Yusuke Tsutsui, Gifu (JP); Makoto Kitagawa, Gifu (JP); Mitsugu Kobayashi, Nagoya (JP)

(73) Assignee: Sanyo Electric Co., Ltd., Osaka (JP)

( * ) Notice: Subject to any disclaimer, the term of this patent is extended or adjusted under 35 U.S.C. 154(b) by 356 days.

(21) Appl. No.: 10/462,813

(22) Filed: Jun. 17, 2003

(65) Prior Publication Data

US 2004/0036666 A1 Feb. 26, 2004

(30) Foreign Application Priority Data

Jun. 19, 2002 (JP) ..... 2002-178199

(51) Int. Cl.
*G09G 5/00* (2006.01)

(52) U.S. Cl. ..... 345/904

(58) Field of Classification Search ..... 345/87, 345/204, 89, 690, 904; 324/770, 771, 130; 702/119, 123

See application file for complete search history.

(56) References Cited

U.S. PATENT DOCUMENTS 5,532,615 A * 7/1996 Kondo et al. ..... 324/770
5,566,088 A * 10/1996 Herscher et al. ..... 702/123
5,956,006 A 9/1999 Sato
6,809,746 B2 * 10/2004 Whittington et al. ..... 345/690

FOREIGN PATENT DOCUMENTS

JP 2632071 4/1997
KR 1996-0002126 1/1996

OTHER PUBLICATIONS

Acquisitions Editor: Christey Bahn, Project Editor: Kim Fryer, Contributors: Woodcock et al., Microsoft Computer Dictionary, Copyright © 1999 By Microsoft Corporation, Published by Microsoft Press . . . , 4th Edition, pp. 115, 169, 170, 388 and 389.*

* cited by examiner

*Primary Examiner*—Richard Hjerpe
*Assistant Examiner*—Kevin M Nguyen
(74) *Attorney, Agent, or Firm*—Morrison & Foerster LLP

(57) ABSTRACT

A liquid crystal display device has a liquid crystal panel, a DA converter for generating a common electrode signal to be applied to a common electrode of a liquid crystal, and a non-volatile memory for encoding an optimum value of the common electrode signal into an ID code and storing the ID code therein. The DA converter generates the optimum common electrode signal corresponding to the ID code read out from the non-volatile memory. A liquid crystal panel manufacturer ships the liquid crystal panel in which the optimum value of the common electrode signal is encoded into the ID code and stored in the non-volatile memory in an inspecting process. The assembling manufacturer using the liquid crystal panel can easily set the optimum value of the common electrode signal. Furthermore, the liquid crystal display device has a CPU decoding the ID code read out from the non-volatile memory. Alternatively, it is possible to supply a data of a value of the common electrode signal to a user of the liquid crystal. The user adjusts the common electrode signal generating circuit by using the data of the value of the common electrode signal.

5 Claims, 8 Drawing Sheets

LIQUID CRYSTAL DISPLAY DEVICE AND ADJUSTING METHOD OF THE SAME

BACKGROUND OF THE INVENTION

1. Field of the Invention

This invention relates to a liquid crystal display device in which a common electrode signal Vcom of the display panel of the display device is easily adjusted by a manufacture of the liquid crystal display device, and an adjusting method thereof.

2. Description of the Related Art

In recent years, liquid crystal panels have been widely used for TV sets or cellular phones. FIG. 8 shows an equivalent circuit diagram of a pixel of a liquid crystal panel according to the conventional art. Such pixels are disposed in a matrix of m rows and n columns. A gate signal line 50 and a drain signal line 51 are formed on an insulating substrate (not shown), intersecting each other. A pixel selecting thin film transistor 52 connected to both the lines 50 and 51 is provided in a periphery of the intersection of those lines. A common electrode signal Vcom is applied to a common electrode of a liquid crystal 53.

Furthermore, a storage capacitance element 55 for storing a voltage of a display electrode 54 for one field is provided. A terminal 56 on one side of the storage capacitance element 55 is connected to a source 52*s* of the pixel selecting TFT 52, and an electrode 57 on another side of the storage capacitance element 55 is applied with an electric potential common to the pixels.

As shown in FIG. 9, when a gate scanning signal Vg of high level is applied to the gate signal line 50, the pixel selecting TFT 52 turns on so that a video signal Sig is transmitted from the drain signal line 51 to the display electrode 54 and stored in the storage capacitance element 55. The video signal Sig applied to the display electrode 54 is applied to the liquid crystal 53, and the liquid crystal 53 is aligned in response to the signal voltage.

If a DC component is constantly applied to the liquid crystal 53, a degrading phenomenon such as burn-in occurs. Therefore, as shown in FIG. 10, a line inversion driving method in which the polarity of the video signal Sig is reversed every 1H period is employed. In this method, it is necessary to set the video signal Sig so as to change symmetrically with respect to the common electrode signal Vcom in order to avoid generating of the DC component.

However, in parctice, the voltage applied to the liquid crystal 53 is lowered by ΔV as shown in FIGS. 9 and 10. This occurs since a parasitic capacitance 60 is formed between the gate and the source 52*s* of the pixel selecting TFT 52 so that the source 11*s* is lowered by ΔV by capacitance coupling, when the gate scanning signal Vg changes from a high level to a low level. This causes the DC component of ΔV to be applied to the liquid crystal 53. Therefore, the common electrode signal Vcom also needs to be lowered by ΔV (to Vcom' in FIG. 10). However, since ΔV varies for each of manufactured liquid crystal panels, the common electrode signal Vcom needs to be adjusted for each of the liquid crystal panels.

FIG. 11 is a flowchart showing a production flow from manufacturing of the liquid crystal panel by a liquid crystal panel manufacturer to shipping the product to the market by an assembling manufacturer. On the side of the liquid crystal panel manufacturer, liquid crystal panels are manufactured (step 1), inspected (step 2), and shipped to the assembling manufacturer (step 3). The assembling manufacturer, which receives the liquid crystal panels, detects and sets an optimum common electrode signal Vcom for each of the liquid crystal panels (step 4). It has been known as a detecting method of the optimum value of the common electrode signal Vcom to scan the common electrode signal Vcom while monitoring brightness of the liquid crystal panel and set the common electrode signal Vcom when the brightness is at the minimum as the optimum common electrode signal Vcom.

Each of the liquid crystal panels, which is set with the optimum common electrode signal Vcom, is assembled in a set such as a TV set or a cellular phone (step 5), and then shipped to the market (step 6).

As described above, since the assembling manufacturer needs to detect the optimum value of the common electrode signal Vcom for the liquid crystal panel and set it therein, the assembling manufacturer is burdened with many manufacturing steps.

Therefore, the invention is directed to a liquid crystal display device in which the assembling manufacturer using the liquid crystal panel can easily set the optimum value of the common electrode signal Vcom, and an adjusting method of the liquid crystal display device.

SUMMARY OF THE INVENTION

The invention provides a liquid crystal display device that includes a liquid crystal panel, a common electrode signal generating circuit generating a common electrode signal applied to a common electrode of the liquid crystal panel, and a non-volatile memory storing a code corresponding to a value of the common electrode signal. The common electrode signal generating circuit generates the common electrode signal corresponding to the code read out from the non-volatile memory.

The invention also provides an adjusting method of a liquid crystal display device. The device includes a liquid crystal panel, a common electrode signal generating circuit generating a common electrode signal applied to a common electrode of the liquid crystal panel, and a non-volatile memory storing a code corresponding to a value of the common electrode signal. The method includes inspecting the liquid crystal panel to detect the value of the common electrode signal, encoding the value of the common electrode signal into the code, inputting the code to the non-volatile memory, reading out the code from the non-volatile memory, and controlling the common electrode signal generating circuit based on the code.

The invention further provides an adjusting method of a liquid crystal display device. The device includes a liquid crystal panel, a common electrode signal generating circuit generating a common electrode signal applied to a common electrode of the liquid crystal panel, a non-volatile memory storing a code corresponding to a value of the common electrode signal, and a CPU decoding the code read out from the non-volatile memory and outputting a command to control the common electrode signal generating circuit to the common electrode signal generating circuit based on a result of the decoding. The method includes inspecting the liquid crystal panel to detect the value of the common electrode signal, encoding the value of the common electrode signal into the code, inputting the code to the non-volatile memory, reading out the code from the non-volatile memory and sending the code to the CPU, and decoding the code at the CPU and outputting the command to control the common electrode signal generating circuit to the common electrode signal generating circuit based on the result of the decoding.

The invention also provides an adjusting method of a liquid crystal display device that includes a liquid crystal panel and a common electrode signal generating circuit generating a common electrode signal applied to a common electrode of the liquid crystal panel. The method includes detecting a value of the common electrode signal at an inspection by a supplier of the liquid crystal panel, supplying data representing the value of the common electrode signal to a manufacturer of the liquid crystal display device who assembles the liquid crystal panel into the liquid crystal display device, and adjusting the common electrode signal generating circuit by using the data representing the value of the common electrode signal at a manufacturing step of the liquid crystal display device by the manufacturer.

DETAILED DESCRIPTION OF THE INVENTION

Figure 1:
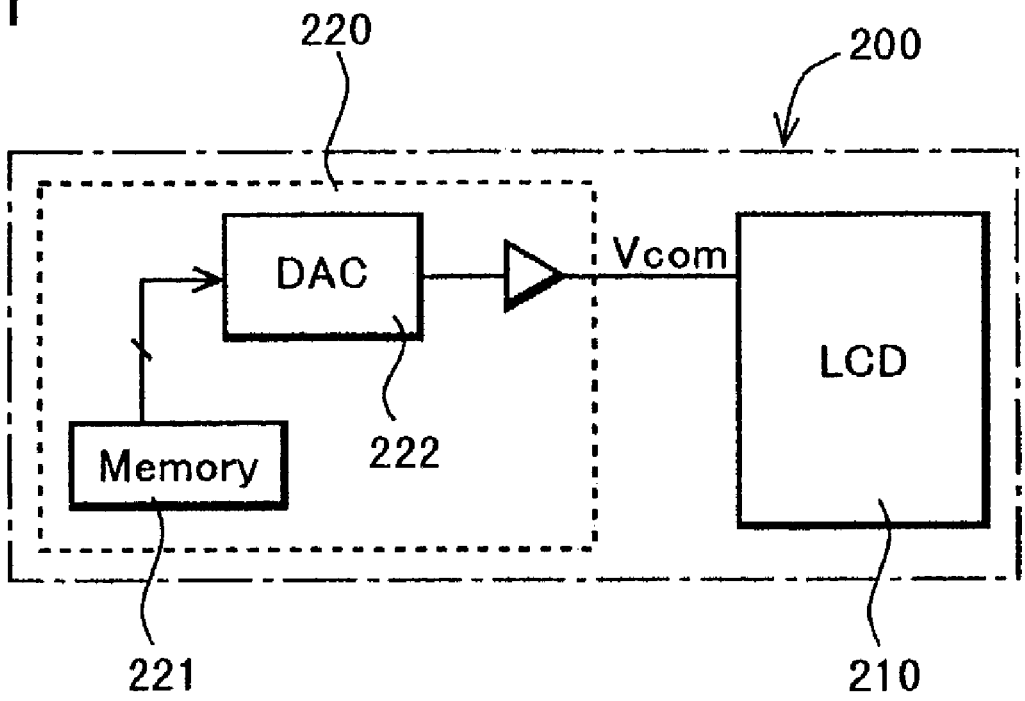
FIG. 1 is a block diagram of a liquid crystal module according to a first embodiment of the invention.

A liquid crystal display device of a first embodiment of the invention is described with reference to FIGS. 1–4. FIG. 1 is a block diagram of a liquid crystal module. The liquid crystal module 200 is provided with a liquid crystal panel 210, and a control IC 220 for controlling a display of the liquid crystal panel 210 by supplying a video signal Sig, a common electrode signal Vcom, and other various drive signals to the liquid crystal panel 210.

Figure 8:
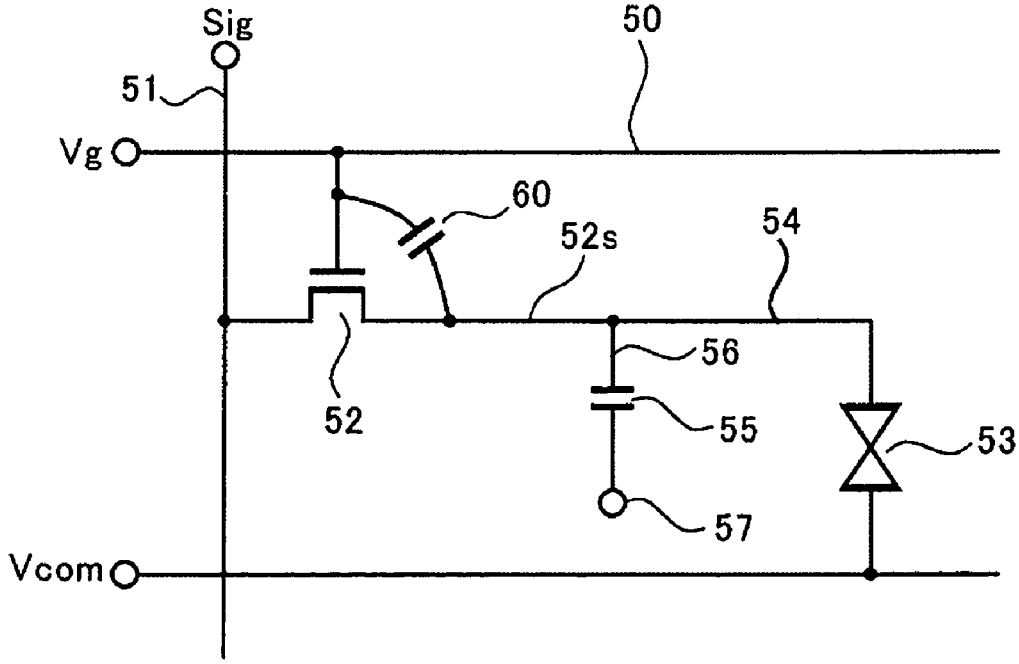
Fig.8 PRIOR ART
FIG. 8 is an equivalent circuit diagram of a pixel of a conventional liquid crystal panel.
Figure 9:
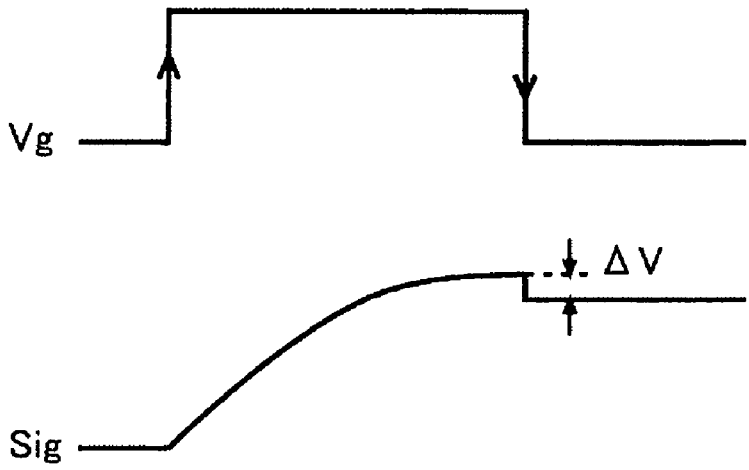
Fig.9 PRIOR ART
FIG. 9 is a waveform diagram of the liquid crystal panel of FIG. 8.
Figure 10:
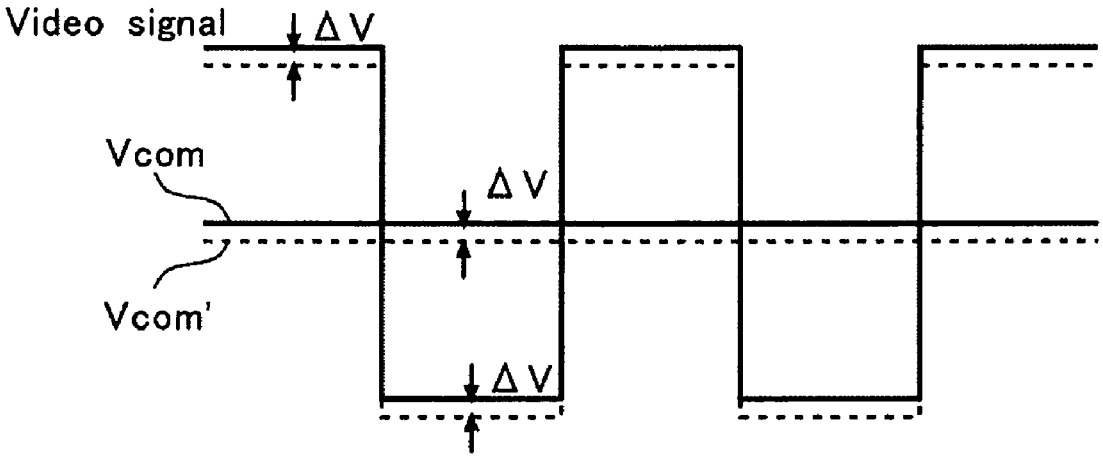
Fig.10 PRIOR ART
FIG. 10 is a waveform diagram of the liquid crystal panel of FIG. 8.
Figure 11:
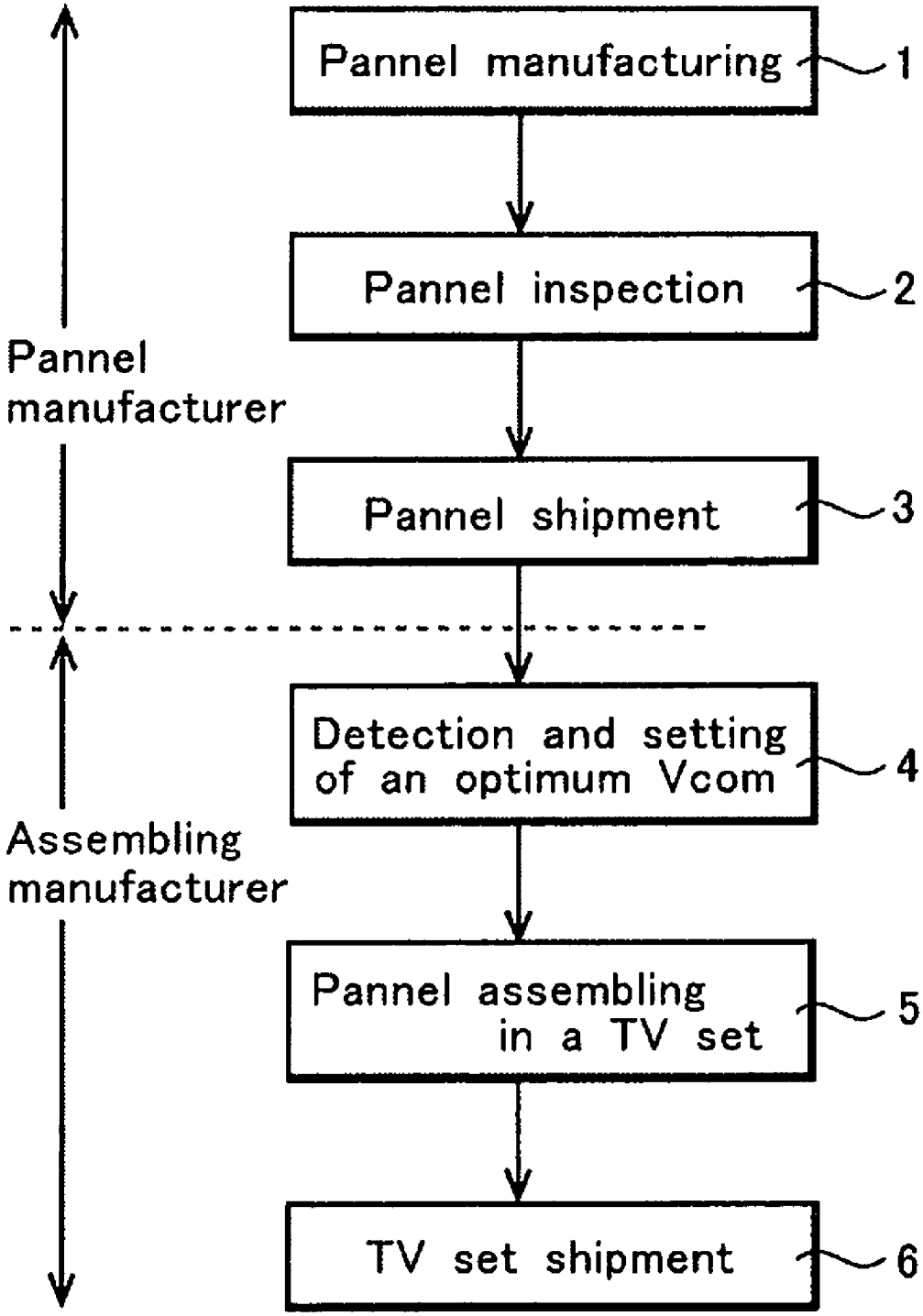
Fig.11 PRIOR ART
FIG. 11 is a flowchart showing a process from manufacturing of the liquid crystal panel by a liquid crystal panel manufacturer to its shipping to the market by an assembling manufacturer.

The liquid crystal panel 210 is provided with a pixel region in which, for example, the pixels shown in FIG. 8 are disposed in a matrix of m rows and n columns, and a horizontal scanner, a vertical scanner or the like, which are not shown, disposed in a periphery of the pixel region. The control IC 220 has a non-volatile memory 221 for storing an ID code of n bit corresponding to an optimum value of the common electrode signal Vcom, and a DA converter 222 (common electrode signal generating circuit) for generating the common electrode signal Vcom of the optimum value corresponding to the ID code read out from the non-volatile memory 221.

Figure 2:
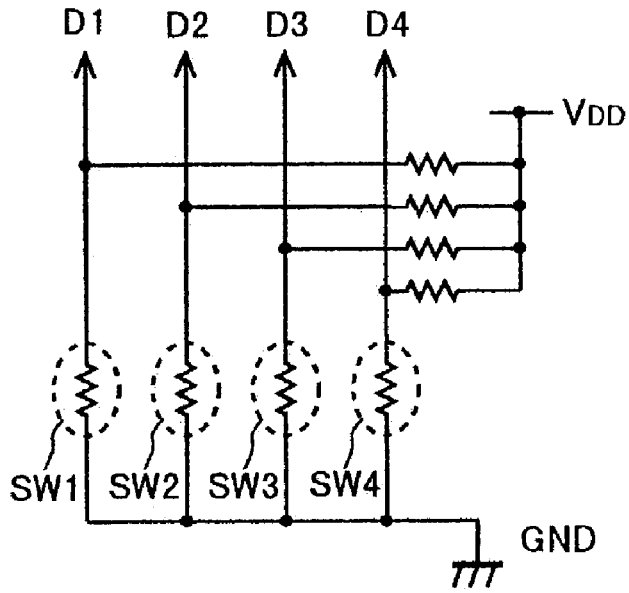
FIG. 2 is a circuit diagram of a non-volatile memory of FIG. 1.

FIG. 2 is a circuit diagram of the non-volatile memory 221. This circuit is a non-volatile memory with four jumper switches SW1 to SW4, and one ends of the four jumper switches SW1 to SW4 are grounded to the GND (ground potential) and other ends of the switches are provided with a power supply voltage VDD. The ID code of four bits (D1, D2, D3, and D4) is stored. Each bit corresponds to closing or opening of the jumper switches SW1 to SW4. For example, when SW1 is closed or in a connected state, a VDD level is outputted, and when SW1 is open or in a disconnected state, a GND level is outputted. Therefore, a binary signal can be stored as D1.

Figure 3A:
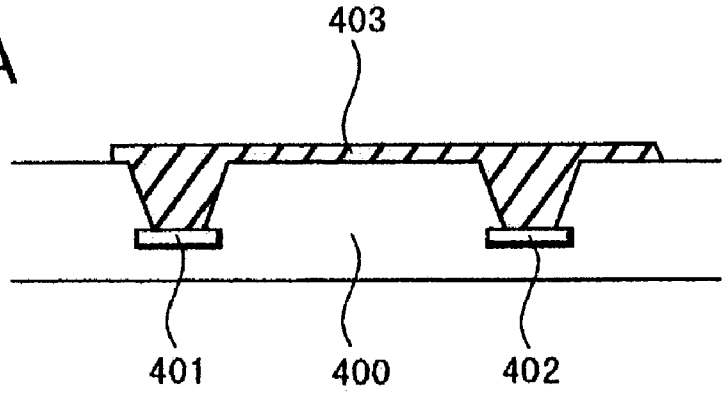
FIGS. 3A and 3B are cross-sectional views of jumper switches of FIG. 2.
Figure 3B:
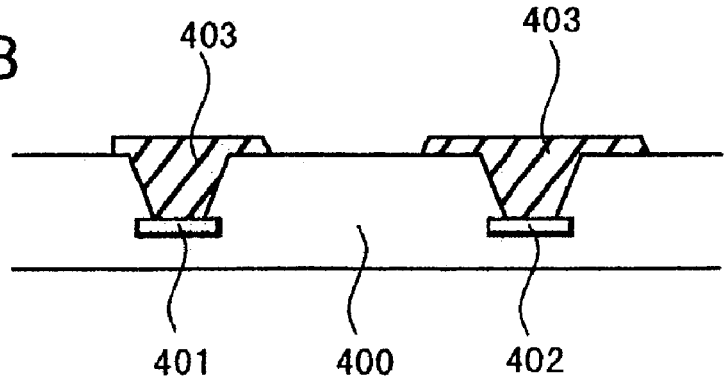

FIGS. 3A and 3B are cross-sectional views of the jumper switches SW1 to SW4. As shown in FIG. 3A, a resistance line 403 made of, for example, solder is connected to pad electrodes 401 and 402 buried in an insulating substrate 400, the pad electrodes 401 and 402 being spaced to each other. As shown in FIG. 3B, the resistance line 403 can be easily and mechanically disconnected. This method using the jumper switches SW1 to SW4 costs less and provides high working efficiency.

The non-volatile memory 221 is not limited to this, but may be, for example, an EPROM or an EEPROM in which the ID code can be electrically written in and read out. The non-volatile memory 221 may be incorporated into the control IC 220 or provided outside of the control IC 220.

Figure 4:
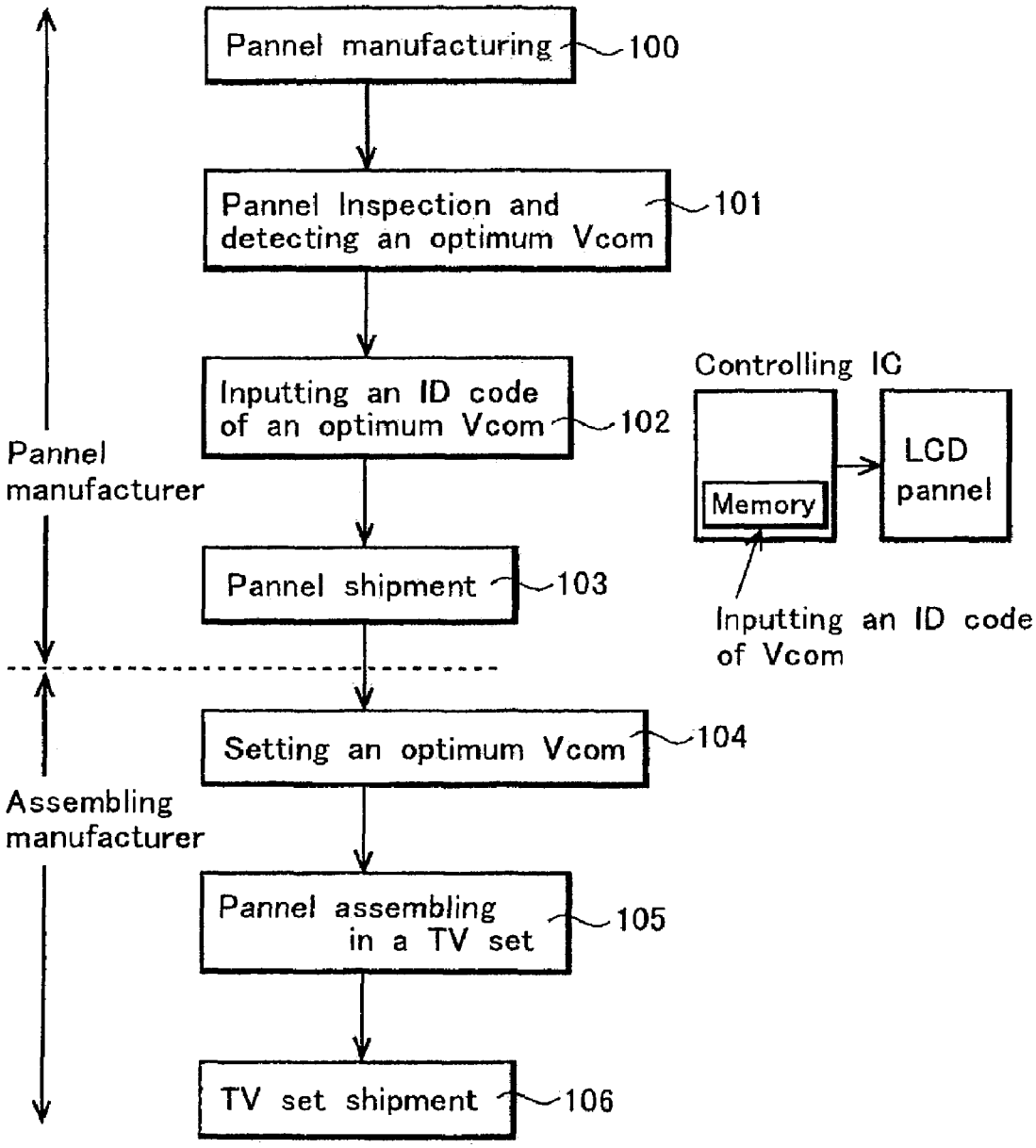
FIG. 4 is a flowchart showing an adjusting method of a common electrode signal of the liquid crystal module of FIG. 1.

FIG. 4 is a flowchart showing an adjusting method of the above described common electrode signal Vcom of the liquid crystal module 200, based on the constructions shown in FIGS. 1-3B. The liquid crystal modules 200, each of which is mounted with the liquid crystal panel 210 and the control IC 220, are manufactured by a liquid crystal panel manufacturer (step 100). The liquid crystal panels 210 in the modules are each inspected and the optimum values of the common electrode signals Vcoms are each detected (step 101). As the detecting method of the optimum value of the common electrode signal Vcom, there is employed the method in which the common electrode signal Vcom is scanned while monitoring brightness of a screen of the liquid crystal panel 210, and set the signal when the brightness is at the minimum as the optimum common electrode signal Vcom.

An operator refers to a prepared table for matching the common electrode signals Vcoms with the ID codes, and the ID codes corresponding to the detected optimum values of the common electrode signals Vcoms are each stored, for example, in each of the above described non-volatile memories 221 made of the jumper switches SW1 to SW4.

Then, the liquid crystal panel manufacturer ships the liquid crystal modules 200 stored with the ID codes to an assembling manufacturer (step 103). When the assembling manufacturer, which receives the liquid crystal modules 200, turns on the control ICs 220, the ID codes are each read out from the non-volatile memories 221 and converted at the DA converters 222, thereby automatically generating the optimum common electrode signals Vcoms (step 104).

Then, each of the liquid crystal panels severally set with the optimum common electrode signal Vcom is assembled in a set such as a TV set and a cellular phone (step 105) and then shipped to the market (step 106). This reduces the process of detecting and setting the common electrode signals Vcoms on the side of the assembling manufacturer.

Figure 5:
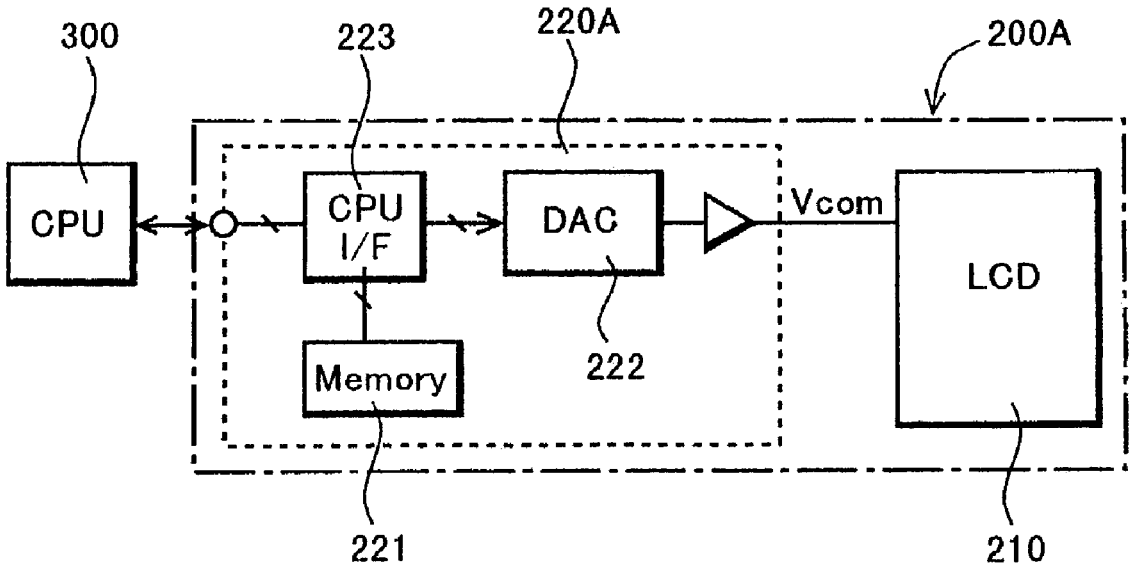
FIG. 5 is a block diagram of a liquid crystal module according to a second embodiment of the invention.

A second embodiment of the invention is described with reference to FIG. 5, which is a block diagram of a liquid crystal module 200A. The liquid crystal module 200A is different from the liquid crystal module 200 of FIG. 1 in that a CPU interface 223 is provided in the control IC 220A and to enable data-communication with a CPU 300 on the side of the assembling manufacturer.

The ID code read out from the non-volatile memory 221 is sent through the CPU interface 223 to the CPU 300, and decoded at the CPU 300. The CPU 300 sends a control command corresponding to the decoded result through the CPU interface 223 to the DA converter 222.

This configuration enhances flexibility of adjusting the common electrode signal Vcom on the side of the assembling manufacturer, as compared with the first embodiment. That is, in the first embodiment, since the ID code read out from the non-volatile memory 221 is directly converted from a digital signal to an analog signal at the DA converter 222, one common electrode signal Vcom corresponds to one ID code. On the other hand, in this embodiment, changing the program which drives the CPU 300 enables to generate an arbitrary common electrode signal Vcom corresponding to one ID code.

Figure 6:
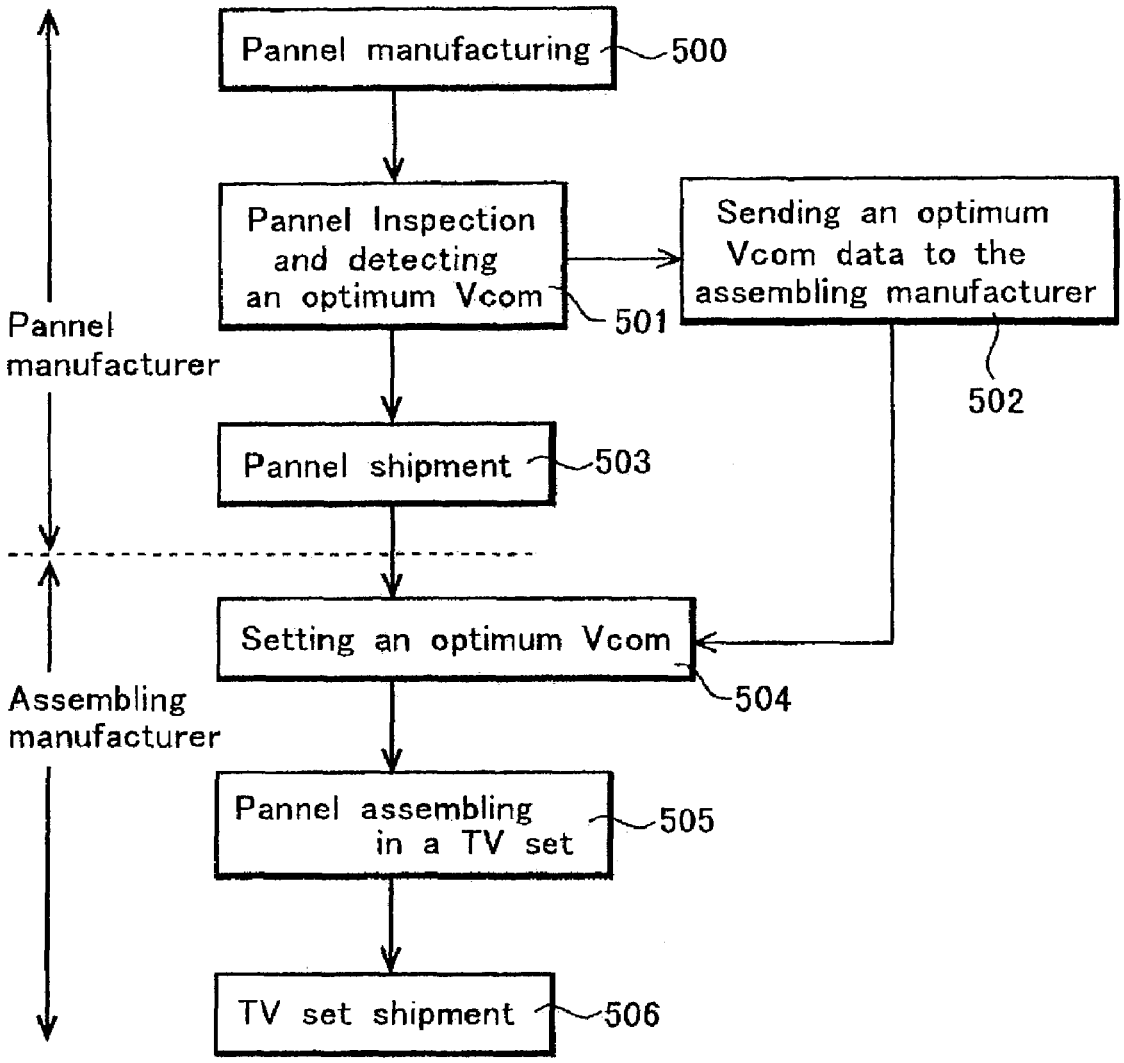
FIG. 6 is a flowchart showing an adjusting method of a common electrode signal according to a third embodiment of the invention.
Figure 7:
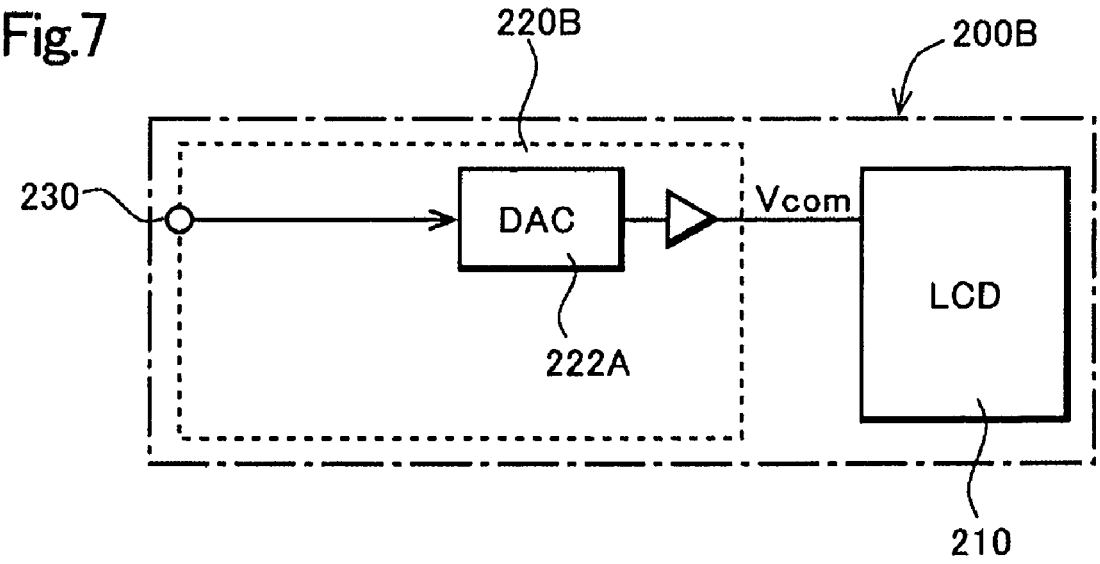
FIG. 7 is a block diagram of a liquid crystal module according to the third embodiment of the invention.

Next, a third embodiment is described with reference to FIGS. 6 and 7. FIG. 6 is a flowchart showing an adjusting method of the common electrode signal Vcom. This adjusting method may be applied to a liquid crystal module 200B provided with a control IC 220B which does not have the non-volatile memory as shown in FIG. 7. In this liquid crystal module 200B, the ID code is applied from an external terminal 230 to a DA converter 222A to generate the common electrode signal Vcom. Note that this adjusting method can be applied to the liquid crystal modules 200 and 200A in the first and second embodiments.

On the side of the liquid crystal panel manufacturer, the liquid crystal modules 200B each of which is mounted with the liquid crystal panel 210 and the control IC 220B are manufactured (step 500). Then, the liquid crystal panels 210 in the modules are each inspected, and the optimum values of the common electrode signals Vcoms are each detected (step 501). As the detecting method of the optimum value of the common electrode signal Vcom, there is employed the method in which the common electrode signal Vcom is scanned while monitoring brightness of a screen of the liquid crystal panel 210, and set the signal when the brightness is at the minimum as the optimum common electrode signal Vcom.

An operator refers to a prepared table for matching the common electrode signals Vcoms with the ID codes, and encodes the optimum values of the detected common electrode signals Vcoms into ID codes. Then, ID code data, which is a table of serial numbers and the ID codes (which corresponds to the optimum values of the common electrode signals Vcoms) of the liquid crystal modules 200B, is sent to the assembling manufacturer (step 502). The table for matching the common electrode signals Vcoms with the ID codes is sent to the assembling manufacturer in advance or sent with the above ID code data. Although the data can be sent by mail, facsimile, or electronic mail, sending the data to a computer of the assembling manufacturer by a predetermined form of an electronic file provides an advantage that the assembling manufacturer can use the data to automate the adjusting work of the common electrode signals Vcoms.

On the other hand, the liquid crystal modules 200B each of which is mounted with the liquid crystal panel 210 and the control IC 220B are sent to the assembling manufacturer (step 503). On the side of the assembling manufacturer which receives the liquid crystal modules 200B, the above described ID code data is applied to the DA converters 222A to generate the optimum common electrode signals Vcoms.

Each of the liquid crystal panels severally set with the common electrode signal Vcom is assembled in a set such as a TV set and a cellular phone (step 505), and then shipped to the market (step 506). This reduces the process of detecting and setting the common electrode signals Vcoms on the side of the assembling manufacturer.

What is claimed is:

1. A liquid crystal display device comprising:

a liquid crystal panel;

a common electrode signal generating circuit generating a common electrode signal applied to a common electrode of the liquid crystal panel; and a non-volatile memory storing a code corresponding to a value of the common electrode signal;

a CPU decoding the code read out from the non-volatile memory and supplying a command for controlling the common electrode signal generating circuit to the common electrode signal generating circuit based on a result of the decoding; and a housing in which the liquid crystal panel and the CPU are disposed, wherein the common electrode signal generating circuit generates the common electrode signal corresponding to the command supplied by the CPU.

2. The liquid crystal display device of claim 1, wherein the non-volatile memory comprises a jumper switching circuit.

3. The liquid crystal display device of claim 1, wherein the non-volatile memory comprises an EPROM or an EEPROM.

4. An adjusting method of a liquid crystal display device, the device comprising a liquid crystal panel, a common electrode signal generating circuit generating a common electrode signal applied to a common electrode of the liquid crystal panel, a non-volatile memory storing a code corresponding to a value of the common electrode signal, and a CPU decoding the code read out from the non-volatile memory and outputting a command to control the common electrode signal generating circuit to the common electrode signal generating circuit based on a result of the decoding, the method comprising:

inspecting the liquid crystal panel to detect the value of the common electrode signal;

encoding the value of the common electrode signal into the code;

inputting the code to the non-volatile memory;

reading out the code from the non-volatile memory and sending the code to the CPU;

placing the liquid crystal panel and the CPU in a housing; and decoding the code using the CPU of the liquid crystal display device and outputting from the CPU the command to control the common electrode signal generating circuit to the common electrode signal generating circuit based on the result of the decoding.

5. The adjusting method of a liquid crystal display device of claim 4, wherein the value of the common electrode signal is an optimum common electrode signal detected.

* * * * *